US006575179B1

(12) United States Patent
Hurskainen

(10) Patent No.: US 6,575,179 B1
(45) Date of Patent: Jun. 10, 2003

(54) ARRANGEMENT OF AN APPARATUS INTENDED FOR PROCESS WASHING

(76) Inventor: Aarne Hurskainen, Peiponkuja 9, FIN-37600 Valkeakoski (FI)

( * ) Notice: Subject to any disclaimer, the term of this patent is extended or adjusted under 35 U.S.C. 154(b) by 0 days.

(21) Appl. No.: 09/806,757

(22) PCT Filed: Sep. 14, 1999

(86) PCT No.: PCT/FI99/00746

§ 371 (c)(1),
(2), (4) Date: Apr. 3, 2001

(87) PCT Pub. No.: WO00/20135

PCT Pub. Date: Apr. 13, 2000

(30) Foreign Application Priority Data

Oct. 5, 1998 (FI) ..... 982150

(51) Int. Cl.[7] ..... B08B 3/02; B08B 9/093
(52) U.S. Cl. ..... 134/104.1; 134/167 R
(58) Field of Search ..... 134/104.1, 167 R, 134/168 R

(56) References Cited

U.S. PATENT DOCUMENTS 4,927,861 A 5/1990 Souto et al.

FOREIGN PATENT DOCUMENTS

DE 2031413 * 12/1971 ..... 134/104.1
JP 9-187413 7/1997

* cited by examiner

*Primary Examiner*—Philip R. Coe
(74) *Attorney, Agent, or Firm*—Connolly Bove Lodge & Lutz, LLP

(57) ABSTRACT

A washing device for washing an interior of a process device is provided. The washing device moveably connected to the process device by a fastening means, and a washing medium of the washing device is led at least partly inside the body of the washing device in order to spray the washing medium to a target via a plurality of nozzles disposed in the body. The washing device has cleaning means including additional nozzles for cleaning parts of the washing device. One or more parts of the washing device have inclined outer surfaces such that the parts are totally visible when viewed from the spraying directions of the additional nozzles.

4 Claims, 2 Drawing Sheets

ARRANGEMENT OF AN APPARATUS INTENDED FOR PROCESS WASHING

TECHNICAL FIELD

The invention relates to an apparatus intended for process washing, by means of which a process device is washable by means of a washing device, that moves inside the same. The washing device is connected moveably in connection the process device by means of fastening means, whereby the washing medium of the washing device is arranged to be led at least partly inside the body of the washing device in order to spray the washing medium to a target by means of nozzles existing in the body of the washing device or correspondingly. The apparatus comprises cleaning means in order to keep the washing device itself clean essentially by influence of the washing medium to be sprayed.

BACKGROUND OF INVENTION

It is nowadays known to use washing devices for process washing, in which the supply assembly for the washing medium is being led totally through the washing device, such as through its body and at least partly inside the fastening means connecting the same to the process device, such as e.g. an attachment frame fastened e.g. with screws, and also e.g. partly inside a running motor and gear acting as the driving device. Furthermore depending on the process device, the washing device comprises e.g. according to FIGS. 1*a* and 1*b* a body, that rotates around an axis, that is essentially perpendicular to its longitudinal axis, or, that rotates essentially around its longitudinal axis, which body is equipped with nozzles in order to direct the washing medium being led through the same to the surfaces to be washed of the process device. For the purpose described above it is known to use most heterogeneous washers, the operating principle of which is to act by influence of the pressure or flow of the washing liquid or, that are as described above moveable by external power.

One problem nowadays still involved with the type of washing devices as described above is such, that because the devices themselves "get dirty", which is naturally due to the washing process itself or in other words because of splashes and flowing down of the washing medium and the substances being loosened by the same from the walls of the process device on the process washing device or because of material, that gets collected on the process washing device during normal operation of the process device, regular maintenance and service measures are required, so that the components and fastening means belonging to the washing device in question would not get covered under a too high amount of mass, in which case the services of the said device would get more difficult and might even totally jeopardize operating of the device totally e.g. due to corrosion. In present washing devices it is known to use furthermore one or several auxiliary washers e.g. according to the one shown in FIG. 1*a,* which as being connected to the body of the process device enables spraying of the washing medium to the surfaces of the washing device. The solution above is one step in the right direction in principle, but an adequate result may not be obtained by the same in practice under all circumstances. This is due to the fact, that certain parts of the washing device tend to collect dirt despite an auxiliary washer thanks to the traditional structures of the same, that is why mass may get collected particularly on critical parts, which may cause harms, such as corrosion.

SUMMARY OF INVENTION

It is the aim of the arrangement according to this invention to achieve a decisive improvement in the problems described above and thus to raise essentially the level of prior art. In order to carry out this aim, the arrangement according to the invention is primarily characterized by, that the cleaning means comprise one or several nozzles placed in the body of the washing device, that is/are directed essentially towards a part of the washing device, and/or, that the washing device is arranged self-cleanable, by arranging the appearance of one or several parts of the washing device totally visible as seen from the spraying direction, such as conical, inclined or in a corresponding manner.

BRIEF DESCRIPTION OF THE DRAWING

As the most important advantages of the arrangement according to the invention may be mentioned simplicity and efficiency of its principle and those structures applicable for the same for most heterogeneous process purposes. Thanks to the arrangement according to the invention it is thus possible to improve significantly the operating conditions of the washing device itself. In addition to the above, the arrangement according to the invention makes the service and maintenance measures of the washing device significantly easier, because in this connection it is not any more needed to "peel" the washing device traditionally off. Thus by the arrangement according to the invention, the operating time of the washing device is essentially extended and simultaneously its service and maintenance needs are significantly decreased.

In the following description, the invention is described in detail with reference to the appended drawings, in which.

BEST AND VARIOUS MODE FOR CARRYING OUT INVENTION

The invention relates to an arrangement of an apparatus intended for process washing, by means of which a process device is washable by means of a washing device. The washing device 1 is connected moveably in connection with the process device by means of fastening means 2. The washing medium of the washing device is arranged to be led at least partly inside the body 1*a* of the washing device in order to spray the washing medium to a target by means of nozzles 1*b* existing in the body 1*a* of the washing device or correspondingly. The apparatus comprises cleaning means in order to keep the washing device 1 itself clean essentially by influence of the washing medium to be sprayed. The cleaning means comprise one or several nozzles 1*b*3, placed in the body 1*a* of the washing device, that is/are directed essentially towards a part of the washing device and/or on the other hand, the washing device is arranged self-cleanable, by arranging the appearance of one or several parts of the washing device totally visible as seen from the spraying direction p, such as conical, inclined or in a corresponding manner.

Figure 1B:
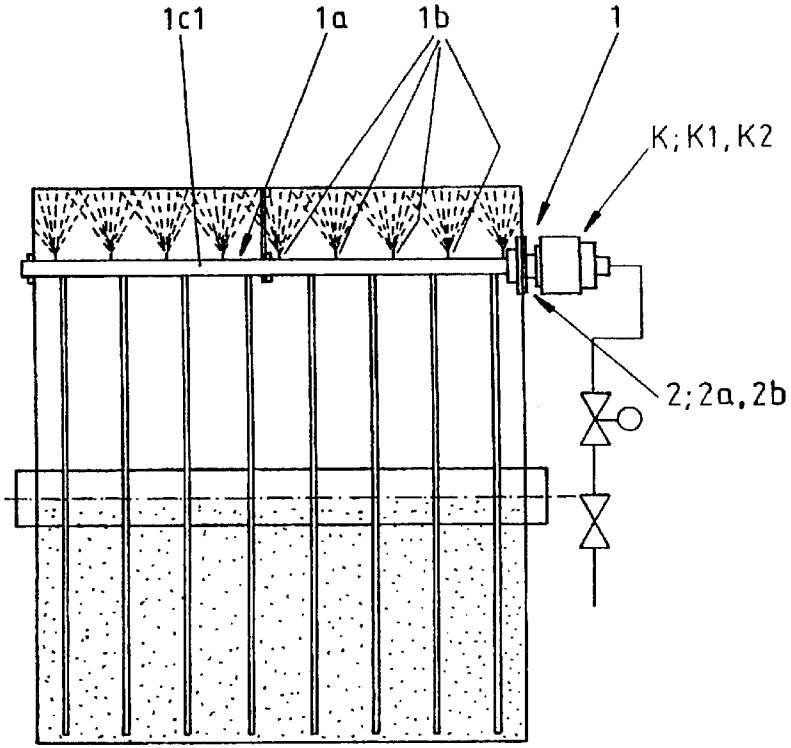
FIG.1b Prior art
FIGS. 1*a* and 1*b* show some traditional washing devices being used for process washing and FIGS. 2*a* and 2*b* show details of solutions being carried out on the principle according to the invention.
Figure 1A:
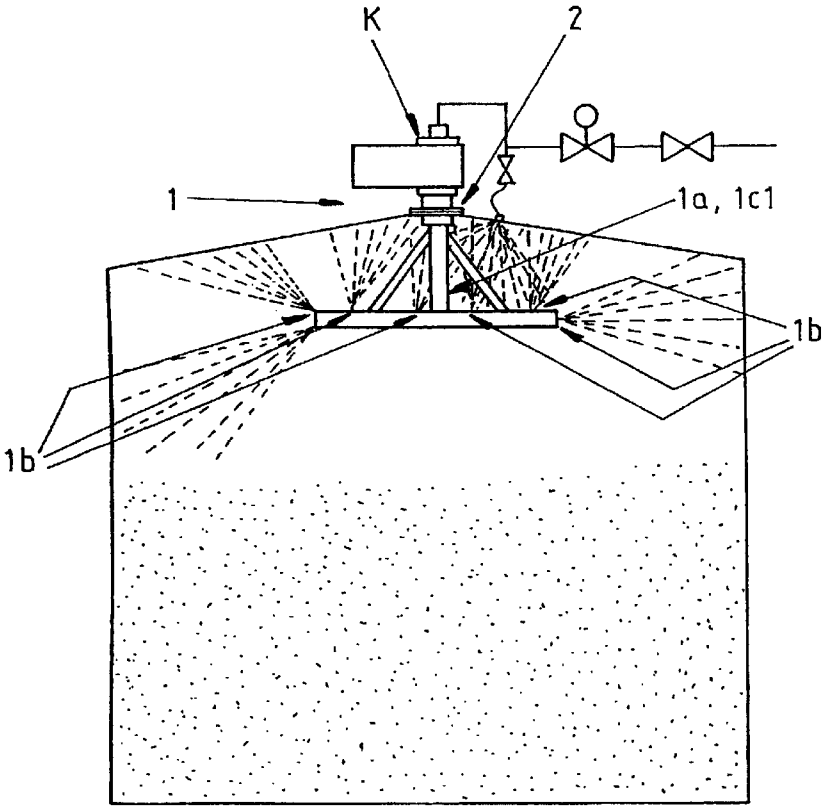
FIG.1a Prior art

Furthermore with reference to the embodiments shown in FIGS. 1*a* and 1*b,* the invention is being applied in connection with a washing device, that is moveable advantageously by means of a driving device K. In this case at least a part of the washing medium supply assembly 1*c*1 is led totally through the washing device, such as inside its body 1*a* and the fastening means 2, such as an attachment frame 2*b* fastened with screws 2*a* or like, connecting the same to the process device, and inside the driving device K, such as a running motor K1 and gear K2 or like. To the body 1*a* of the washing device, there has been arranged furthermore at least two nozzles 1*b*3, that are directed e.g. according to FIG. 2*a* towards each other and towards a part existing in the body 1*a* of the washing device, such as an intermediate bearing VL or like.

Figure 2B:
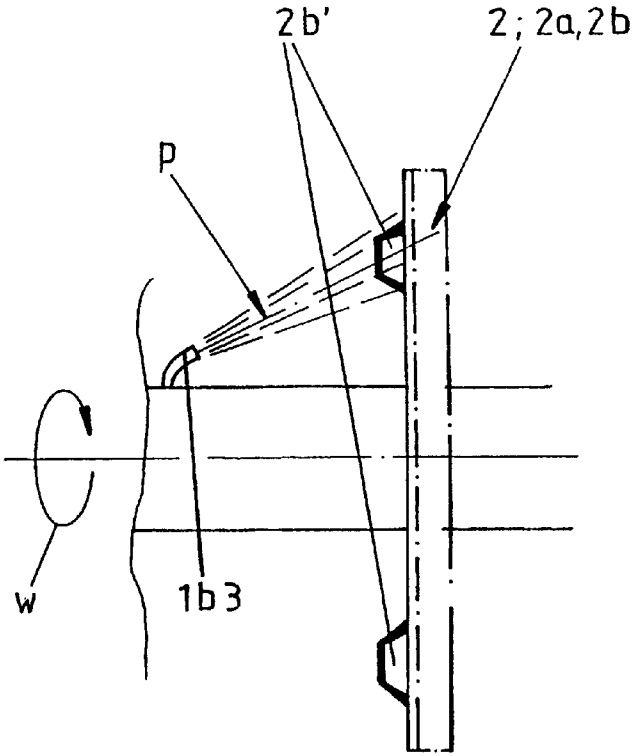
Figure 2A:
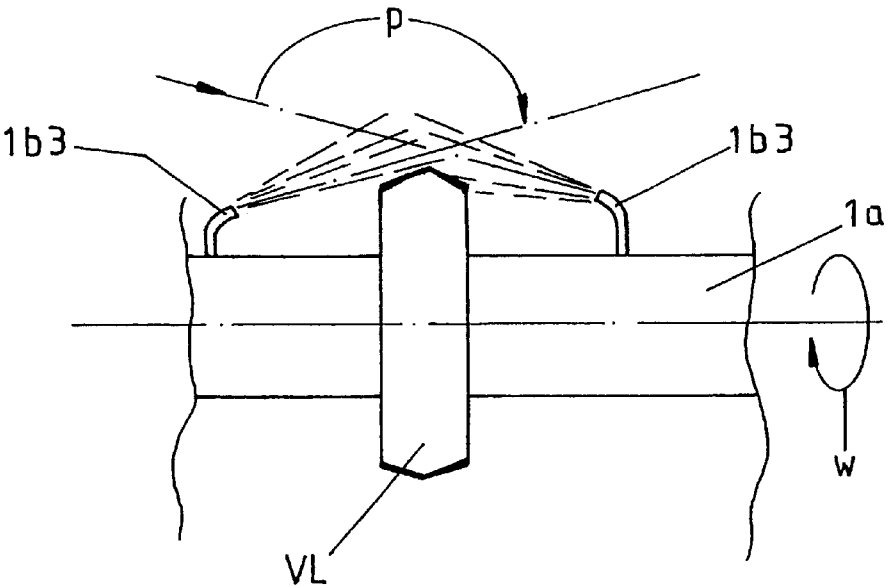

Furthermore as an advantageous embodiment of the invention, the fastening means 2 of the washing device, such as the internal parts 2*b*' of the attachment frame 2*b* fastened with screws 2*a,* are arranged at least by the opposite outer surfaces of the same inclined towards each other on the principle shown in FIG. 2*b.* Furthermore with reference to the embodiment shown in FIG. 2*a,* the outer surfaces of the parts existing in the body 1*a* of the washing device, such as of the casing structure of the intermediate bearing VL, are arranged inclined in one or several parts when viewed in a cross section.

It is obvious, that the invention is not limited to the embodiments presented or described above, but it can be modified within the basic idea of the invention even to a great extent. First of all the body of the washing device may be, differing from the T-shaped shown e.g. in FIG. 3, L-shaped or it may be formed of three or more horizontal bodies, that are attached to the center body radially. Correspondingly the body of the embodiment according to FIG. 2, may be free by the end, that is opposite to the driving device, or it may be mounted in bearings to the washing device by both ends of the same. In addition to the above it is naturally clear, that the arrangement according to the invention may be applied in connection with a washing device, that is moveable in any possible way so, that the presented embodiments are intended only to show certain common ways based on traditional washing device structures to carry out the invention.

What is claimed is:

1. A washing device disposed inside a process device for washing the process device, said washing device comprising:

fastening means moveably connecting the washing device to the process device;

a body carrying a washing medium of the washing device at least partly inside the body;

nozzles disposed within the body and arranged to spray the washing medium to a target;

cleaning means for cleaning the washing device, wherein the cleaning means comprise at least one other nozzle disposed in the body and directed towards at least one part of the washing device to spray the washing medium to the at least one part of the washing device and clean the at least one part of the washing device, wherein the at least one part of the washing device has outer surfaces that are inclined such that the at least one part of the washing device is totally exposed to a spray of the washing medium from the at least one other nozzle.

2. A washing device according to claim 1, wherein the fastening means includes an attachment frame having internal parts fastened with screws, wherein the at least one other nozzle is directed towards the internal parts, and wherein the internal parts include opposite outer surfaces inclined towards each other.

3. A washing device according to claim 1, further comprising a bearing disposed in said body, wherein the at least one other nozzle is directed toward a casing structure of the bearing, and wherein the casing structure includes outer surfaces that are inclined in one or more parts when viewed from a cross section.

4. A washing device according to claim 2, further comprising a bearing disposed in said body, wherein the at least one other nozzle is directed toward a casing structure of the bearing, and wherein the casing structure includes outer surfaces that are inclined in one or more parts when viewed from a cross section.

* * * * *